US009454113B2

(12) United States Patent
Kuwata et al.

(10) Patent No.: US 9,454,113 B2
(45) Date of Patent: Sep. 27, 2016

(54) IMAGE FORMING APPARATUS

(71) Applicant: CANON KABUSHIKI KAISHA, Tokyo (JP)

(72) Inventors: Takashi Kuwata, Suntou-gun (JP); Kenji Abe, Suntou-gun (JP); Hideki Ohta, Numazu (JP); Takamichi Matsuo, Suntou-gun (JP); Youhei Suzuki, Suntou-gun (JP); Takuro Mita, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/525,343

(22) Filed: Oct. 28, 2014

(65) Prior Publication Data

US 2015/0043933 A1 Feb. 12, 2015

Related U.S. Application Data

(63) Continuation of application No. 12/910,192, filed on Oct. 22, 2010, now Pat. No. 8,909,124.

(30) Foreign Application Priority Data

Oct. 30, 2009 (JP) ..... 2009-251390

(51) Int. Cl.
*G03G 15/00* (2006.01)
*B41J 29/38* (2006.01)
(Continued)

(52) U.S. Cl.
CPC ..... *G03G 15/205* (2013.01); *G03G 15/2028* (2013.01); *G03G 15/234* (2013.01); *G03G 15/6579* (2013.01); *G03G 2215/0043* (2013.01);
(Continued)

(58) Field of Classification Search
CPC ..... G03G 15/205
See application file for complete search history.

(56) References Cited

U.S. PATENT DOCUMENTS 5,196,897 A 3/1993 Trask
6,219,521 B1 4/2001 Burdick et al.
7,819,516 B2 10/2010 Groenenberg et al.
(Continued)

FOREIGN PATENT DOCUMENTS

CN 1440519 A 9/2003
CN 101424912 A 5/2009
(Continued)

OTHER PUBLICATIONS

Chinese Office Action dated Jul. 20, 2012, issued in counterpart Chinese Application No. 201010528661.3, and English-language translation thereof.

*Primary Examiner* — Daniel J Colilla
*Assistant Examiner* — Ruben Parco, Jr.
(74) *Attorney, Agent, or Firm* — Fitzpatrick, Cella, Harper & Scinto

(57) ABSTRACT

An image forming apparatus includes a sheet feed unit which feeds a sheet to an image forming unit forming an image on the sheet, a re-transport roller which reverses the sheet with a toner image fixed on the sheet and re-transports the sheet to the image forming unit, and a control unit which controls a sheet feed operation of the sheet feed unit for feeding the sheet. As the temperature of the re-transport roller sensed by the temperature sensing unit is decreased, the control unit retards the timing at which the sheet feed operation when a duplex image formation in which the image is formed on both sides of the sheet is performed after a one-side image formation is completed.

6 Claims, 12 Drawing Sheets

(51) Int. Cl.
*G03G 15/20* (2006.01)
*G03G 15/23* (2006.01)

(52) U.S. Cl.
CPC ..... *G03G 2215/00586* (2013.01); *G03G 2215/00599* (2013.01); *G03G 2215/00772* (2013.01)

(56) References Cited

U.S. PATENT DOCUMENTS

| | | | | |
|---|---|---|---|---|
| 8,135,298 | B2 | 3/2012 | Ogiso et al. | |
| 8,909,124 | B2 * | 12/2014 | Kuwata et al. | 399/401 |
| 2002/0039508 | A1 | 4/2002 | Tsusaka et al. | |
| 2002/0044170 | A1 * | 4/2002 | Takahashi et al. | 347/40 |
| 2002/0097428 | A1 | 7/2002 | Ferlitsch | |
| 2007/0189783 | A1 | 8/2007 | Hattori | |
| 2009/0047521 | A1 | 2/2009 | Groenenberg et al. | |
| 2009/0110418 | A1 | 4/2009 | Ogiso et al. | |
| 2009/0116866 | A1 | 5/2009 | Hollands et al. | |

FOREIGN PATENT DOCUMENTS

| | | | | | |
|---|---|---|---|---|---|
| CN | 101426655 | A | | 5/2009 | |
| EP | 0 526 714 | A1 | | 2/1993 | |
| JP | 8-254938 | A | | 10/1996 | |
| JP | 2000-330741 | A | | 11/2000 | |
| JP | 2000330741 | A | * | 11/2000 | B41J 29/38 |
| JP | 2005-215229 | A | | 8/2005 | |
| JP | 2008-065146 | A | | 3/2008 | |
| JP | 2008065146 | A | * | 3/2008 | G03G 21/20 |
| JP | 2009-204935 | A | | 9/2009 | |
| JP | 2009204935 | A | * | 9/2009 | G03G 21/14 |

* cited by examiner

IMAGE FORMING APPARATUS

This application is a continuation application of application Ser. No. 12/910,192 filed on Oct. 22, 2010, now allowed.

BACKGROUND OF THE INVENTION

1. Field of the Invention

The present invention relates to an image forming apparatus, and more particularly, to an image forming apparatus which fixes a toner image by a fixing unit.

2.Description of the Related Art

Conventionally, in an electrophotographic image forming apparatus such as a duplicating machine, a printer or a facsimile machine, when an image is formed on a sheet, a toner image formed in an image forming unit is transferred onto the sheet. Then, the toner image is heated, pressurized and fixed onto the sheet by a fixing unit, so as to form the image onto the sheet.

As the image forming apparatus, there is an image forming apparatus including a re-transport unit which reverses the sheet with the toner image fixed to a first side of the sheet, and transports the sheet to the image forming unit again. In duplex printing in which images are formed on both sides of the sheet, the sheet with the image formed on the first side of the sheet is reversed and transported to the image forming unit again by the re-transport unit. As a result, the image is formed on a reverse side of the sheet.

As the fixing unit, there is a fixing unit using a thermal-pressure fixing system. This fixing unit includes a fixing roller and a pressure roller, which simultaneously apply heat and pressure to the sheet so as to fix the toner image to the sheet. In a case of this fixing unit, when the toner image is fixing to the sheet, the fixing roller, which heats the sheet, gives a substantial amount of heat to the sheet. Thus, when the toner image is fixed, moisture contained in the sheet evaporates into water vapor.

After the water vapor is generated, when a main body of the image forming apparatus is set in a relatively low temperature state, the water vapor may condense within a sheet-transport path. If dew condensation occurs, when the sheet passes through the sheet-transport path, water droplets adhere to the sheet. In the conventional image forming apparatus, in order to prevent this dew condensation, the air-tightness of the fixing unit is increased so as to absorb the water vapor within the fixing unit. In addition, for example, there is an image forming apparatus which discharges the generated water vapor out of the apparatus through a louver provided on an upper portion of the image forming apparatus (see Japanese Patent Application Laid-Open No. H08-254938).

As operations of the conventional image forming apparatus have been accelerated in recent years, the amount of heat transferred from the fixing roller to the sheet has also increased, and thus the amount of the generated water vapor itself has also increased. Also, in a conventional configuration in which the air-tightness of the fixing unit is increased so as to absorb the water vapor within the fixing unit, the absorption of the water vapor is limited, and collection of the water vapor has become difficult.

If the water vapor is not sufficiently discharged and collected, when the main body of the image forming apparatus is set in the relatively low temperature state, the water vapor condenses on a guide member which guides the sheet to be reversed, in the duplex printing, for example. In recent years, in order to downsize the image forming apparatus and to improve productivity in the duplex printing, a pair of switchback rollers, provided in the re-transport unit so as to reverse and transport the sheet, may be arranged near the fixing unit. In this case, the water vapor also condenses on surfaces of the pair of switchback rollers.

When this dew condensation occurs, for example, as in a cold start, if duplex printing is attempted in a state where the main body of the image forming apparatus is not sufficiently heated up, the water vapor condensing on the guide member and the pair of switchback rollers adheres as the water droplets to the sheet to be reversed and transported. When the water droplets adhere, the electrical resistance value at a portion of the surface of the sheet at which the water droplets adhere decreases relative to a surrounding area without the adherence of the water droplets on the surface of the sheet. Thus, when the toner image is transferred by a transfer unit, a poor image that includes, for example, blurring or the like, due to poor transfer may be generated, or wrinkles or roughness of the sheet may be caused.

For example, if first-side printing is continuously performed in a cold state, the moisture contained in the sheet becomes water vapor due to the heat from the fixing unit, and the water vapor adheres to a pair of reverse rollers located above the fixing unit. If the duplex printing is set after first-side printing, the moisture, which has adhered to the pair of switchback rollers in the first-side printing, adheres to the sheet to be transported for performing the duplex printing.

SUMMARY OF THE INVENTION

The present invention has been made in view of such a present situation, and the present invention provides an image forming apparatus which can prevent a reduction in image quality level due to dew condensation in duplex image formation.

An image forming apparatus of the present invention includes a sheet feed unit which feeds a sheet to an image forming unit forming a toner image on the sheet; a fixing unit which fixes the toner image to the sheet; a re-transport roller which reverses the sheet with the toner image fixed on the sheet and re-transports the sheet to the image forming unit when forming an image on both sides of the sheet; a temperature sensing unit which senses a temperature of the re-transport roller; and a control unit which controls a sheet feed operation of the sheet feed unit, wherein, as the temperature of the re-transport roller sensed by the temperature sensing unit is lower, the control unit retards a timing to cause the sheet feed unit to start the sheet feed operation when a duplex image formation in which the image is formed on both sides of the sheet is performed after a one-side image formation is completed.

The present invention can prevent the reduction in the image quality level due to dew condensation in duplex image formation, based on the temperature information.

Further features of the present invention will become apparent from the following description of exemplary embodiments with reference to the attached drawings.

DESCRIPTION OF THE EMBODIMENTS

Figure 1:
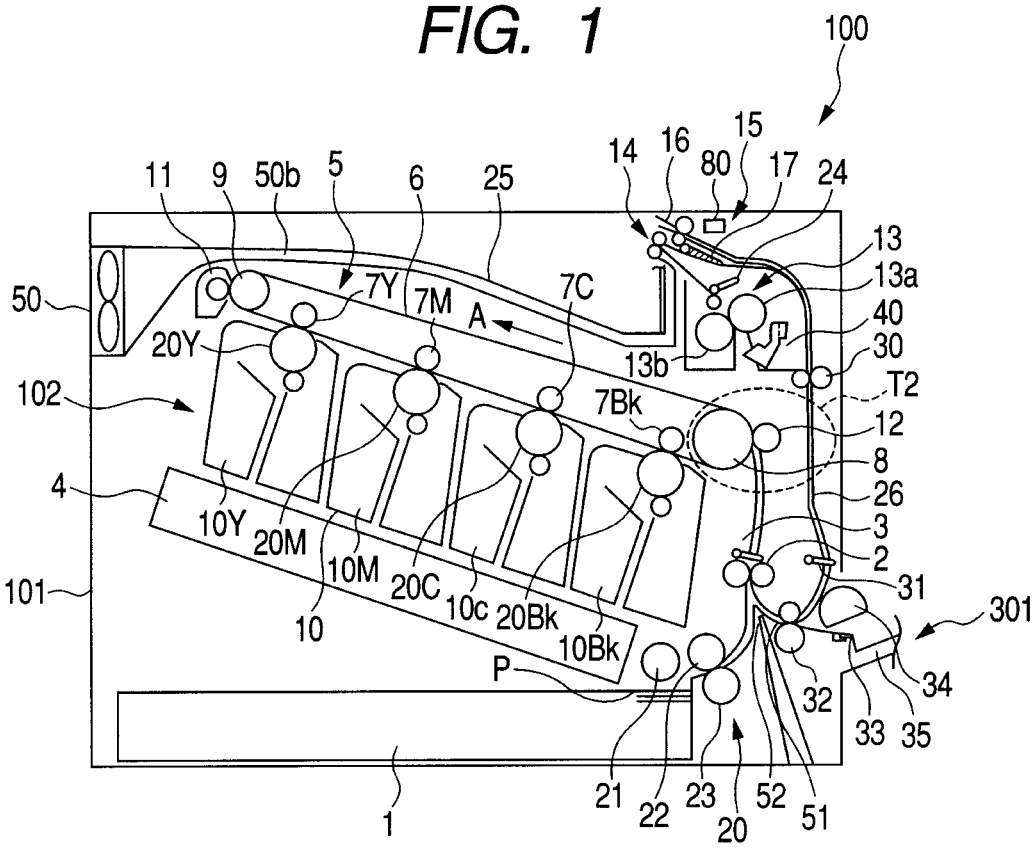
FIG. 1 illustrates a configuration of a laser printer which is an example of an image forming apparatus according to a first embodiment of the present invention.

Hereinafter, embodiments of the present invention will be described in detail using the drawings. FIG. 1 illustrates a configuration of a laser printer which is an example of an image forming apparatus according to a first embodiment of the present invention. A laser printer (hereinafter referred to as "printer") 100 includes a laser printer main body (hereinafter referred to as "printer main body") 101, an image forming unit 102 which forms an image on a sheet P, a sheet feed apparatus 20 which is a sheet feed unit that feeds the sheet P from a sheet feed cassette 1, and a manual feed unit 301 provided on one side of the laser printer 100.

The image forming unit 102 includes a scanner unit 4, and four process cartridges 10 (10Y, 10M, 10C and 10Bk) which form toner images of four colors of yellow (Y), magenta (M), cyan (C) and black (Bk). Moreover, the image forming unit 102 includes an intermediate transfer unit 5 arranged above the process cartridges 10. Here, the respective process cartridges 10 include photosensitive drums (20Y, 20M, 20C and 20Bk). Both end portions of each photosensitive drum (20Y, 20M, 20C and 20Bk) are rotatably supported by a supporting member. A drive force is transmitted to one end portion from a drive motor (not illustrated) so as to drive each photosensitive drum (20Y, 20M, 20C and 20Bk) to rotate clockwise.

The intermediate transfer unit 5 includes an intermediate transfer belt 6 stretched around a drive roller 8 and a tension roller 9. Moreover, the intermediate transfer unit 5 includes primary transfer rollers (7Y, 7M, 7C and 7Bk). Each primary transfer roller (7Y, 7M, 7C and 7Bk) is provided within the intermediate transfer belt 6 so as to contact with the intermediate transfer belt 6 at a position opposed to each photosensitive drum (20Y, 20M, 20C and 20Bk). The intermediate transfer belt 6 is constructed by a film member, and also is arranged so as to contact with each photosensitive drum (20Y, 20M, 20C and 20Bk). The intermediate transfer belt 6 is rotated in a direction denoted by an arrow A, by the drive roller 8 driven by a drive unit (not illustrated).

A positive transfer bias is applied to the intermediate transfer belt 6 by the primary transfer roller (7Y, 7M, 7C and 7Bk). As a result, toner images having negative polarity of the respective colors on the photosensitive drums are sequentially transferred onto the intermediate transfer belt 6 in a multiple manner. Thereby, a full-color image is formed on the intermediate transfer belt. In the intermediate transfer unit 5, a secondary transfer roller 12 is provided at a position opposed to the drive roller 8. The secondary transfer roller 12 is included in a secondary transfer unit T2 which transfers the full-color image formed on the intermediate transfer belt, onto the sheet P.

A fixing unit 13 is arranged above the secondary transfer roller 12. A pair of delivery rollers 14 and a side reversing unit 15 are arranged at an upper left portion, which is on a downstream side in a sheet transport direction in the fixing unit 13. The side reversing unit 15 includes a pair of reverse rollers 16, which is a forward/reverse rotatable re-transport roller, and a switching member 17. In duplex printing (two-sides image formation), an image is formed on a reverse side (second side) of a sheet with an image formed on one side (first side) of the sheet, by the image forming unit 102. In FIG. 1, in the duplex printing, a re-transport path 26 reverses the side of the sheet and guides the sheet to the image forming unit 102 (the secondary transfer unit T2) again. The pair of reverse rollers 16 and the re-transport path 26 are included in a refeed unit which feeds the sheet with the image formed on the one side (first side) of the sheet to the image forming unit 102 again. A pair of duplex transport rollers 30 is provided on the re-transport path 26. A fan 50 takes outside air into the printer main body.

An image forming operation in the printer 100 with the above configuration will be described. When the image forming operation is started, first, the scanner unit 4 emits laser light based on image information from a personal computer (not illustrated), and sequentially exposes surfaces of the photosensitive drums (20Y, 20M, 20C and 20Bk), which are uniformly charged to a predetermined polarity and potential, so as to form electrostatic latent images on the photosensitive drums. Subsequently, these electrostatic latent images are developed with toner so as to be visualized.

For example, first, the scanner unit 4 emits laser light depending on an image signal for a yellow component color, onto the photosensitive drum 20Y so as to form a yellow electrostatic latent image on the photosensitive drum 20Y. This yellow electrostatic latent image is developed with yellow toner from a developer unit so as to be visualized as a yellow toner image. Next, this toner image arrives at a primary transfer unit where the photosensitive drum 20Y contacts with the intermediate transfer belt 6, along with the rotation of the photosensitive drum 20Y. The yellow toner image on the photosensitive drum is transferred onto the intermediate transfer belt 6 by a transfer bias applied to the primary transfer roller 7Y.

Next, a part of the intermediate transfer belt 6 carrying the yellow toner image moves. Before this movement, a magenta toner image is formed on the photosensitive drum 20M in a manner similar to the above. The magenta toner image is transferred onto the yellow toner image on the intermediate transfer belt 6. Similarly, as the intermediate transfer belt 6 moves, a cyan toner image and a black toner image are transferred so as to be superimposed on the yellow toner image and the magenta toner image, respectively, in the primary transfer unit. As a result, a full-color toner image is formed on the intermediate transfer belt 6.

Concurrently with this toner image forming operation, the sheets P received in the sheet feed cassette 1 are fed out by a pickup roller 21. Then, the sheets P are separated one by one by a feed roller 22 and a retard roller 23. Each sheet P is transported to a pair of registration rollers 2, and skewing of the sheet P is corrected. After the skewing of the sheet P is corrected by the pair of registration rollers 2, the pair of registration rollers 2 is driven so as to adjust positions of the full-color toner image on the intermediate transfer belt and the sheet P in the secondary transfer unit T2. A top sensor 3 is provided on a downstream side of the pair of registration rollers 2. The top sensor 3 senses the position of the sheet P and performs jam sensing. In the present embodiment, the sheet feed apparatus 20 which feeds the sheet to the image forming unit 102 includes the sheet feed cassette 1, the pickup roller 21, the feed roller 22, the retard roller 23 and the pair of registration rollers 2.

A leading end of the sheet P is sensed by the top sensor 3, and the sheet P is transported to the secondary transfer unit T2 by the pair of registration rollers 2 so that the positions of the full-color toner image on the intermediate transfer belt 6 and the sheet P are adjusted in the secondary transfer unit T2. In the secondary transfer unit T2, a secondary transfer bias applied to the secondary transfer roller 12 causes the entire full-color toner image to be transferred onto the sheet P. Toner which has not been transferred onto the sheet P and has remained in the secondary transfer unit T2 is removed from the intermediate transfer belt 6 by a toner removing member of a cleaning unit 11 contacting with the intermediate transfer belt 6.

The sheet P to which the full-color toner image has been transferred is transported to the fixing unit 13. The fixing unit 13 includes a pressure roller 13*a* connected to a drive unit (not illustrated) which can change a rotation speed, and a heating roller 13*b* which has a heater as a heat source and contacts with the pressure roller 13*a* at a constant pressure. Heat and pressure are applied to the toner of each color by the heating roller 13*b* and the pressure roller 13*a* provided in the fixing unit 13. Then, the toner of each color is fused to cause color mixture, and is fixed as the full-color image to the sheet P.

A loop sensing unit 40 including a sensor flag and a photosensor (not illustrated) is provided in the fixing unit 13. The loop sensing unit 40 senses an amount of loop generated when the sheet P is transported between the secondary transfer unit T2, and a nip between the pressure roller 13*a* and the heating roller 13*b*. A controller illustrated in FIG. 5, which is a control unit, changes (decelerates) the rotation speed of the pressure roller 13*a* in the fixing unit 13, based on a sensing signal from the loop sensing unit 40. As a result, the sheet P is transported in a state where the loop equal to or more than a predetermined amount is secured. Since the sheet P is transported in the state where the loop equal to or more than the predetermined amount is secured, the fixing unit 13 does not affect the sheet-transport speed for the sheet P when the sheet P passes through the secondary transfer unit T2. Therefore, poor transfer is prevented.

Subsequently, in a case of first-side printing (in a one-side image formation mode) in which the image is formed only on the first side of the sheet, the switching member 17 is moved to a position illustrated in FIG. 1 for guiding the sheet to a transport path leading to an delivery tray 25. The switching member 17 switches the transport path through which the sheet is transported, between the transport path leading to the delivery tray 25, and a transport path toward the side reversing unit 15 used in the duplex printing. The sheet P which has passed through the fixing unit 13 and has the toner image fixed to the first side of the sheet is delivered with the image side facing down, onto the delivery tray 25 provided on an upper surface of the printer main body, by the pair of delivery rollers 14. In the case of the first-side printing (in the first-side image formation mode), the sheet is delivered to the outside of the apparatus without passing through the refeed unit including the pair of reverse rollers 16 and the re-transport path 26.

In a case of the duplex printing (in a duplex image formation mode) in which the images are formed on both sides of the sheet, the switching member 17 is turned in a clockwise direction by a drive mechanism such as a solenoid (not illustrated). The sheet P which has passed through the fixing unit 13 is transported to the pair of reverse rollers 16 in the side reversing unit 15. The sheet is transported by forward rotation of the pair of reverse rollers 16. After a trailing end of the sheet P passes over a branch point branching into the re-transport path 26, the sheet P is fed into the re-transport path 26 by reverse rotation of the pair of reverse rollers 16.

The sheet P fed into the re-transport path 26 is transported to the pair of registration rollers 2. After the skewing of the sheet P is corrected by the pair of registration rollers 2, the sheet P is fed to the secondary transfer unit T2 again at a timing synchronized with a leading end of the toner image which has been primarily transferred onto the intermediate transfer belt 6. Subsequently, the sheet P is delivered through the secondary transfer unit T2, the fixing unit 13 and the pair of delivery rollers 14, onto the delivery tray 25.

If the sheet is manually fed, the sheets stacked on a manually-fed sheet stacking unit 35 are fed out by a half-moon-shaped sheet feed roller 34 whose periphery is partially cut out. The sheets fed out by the sheet feed roller 34 are separated by a separation pad 33, and then each sheet is transported to the pair of registration rollers 2 by a transport roller 32. Subsequently, each sheet is fed to the secondary transfer unit T2 by the pair of registration rollers 2.

Figure 2:
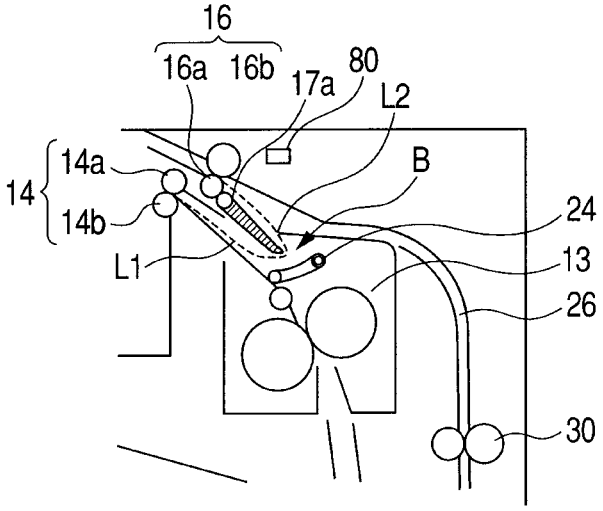
FIG. 2 is an enlarged view of a main portion of the laser printer.

FIG. 2 is an enlarged view of a main portion of the printer 100. In FIG. 2, a branch point B is set by a leading end of the switching member 17 at an arbitrary position within an operation range of the switching member 17. The pair of reverse rollers 16 (16*a* and 16*b*) is arranged at a position where a length L2 from the branch point B is shorter than a length L1 from the branch point B to the pair of delivery rollers 14 (14*a* and 14*b*). Furthermore, the pair of reverse rollers 16 is arranged so that a nip position of the pair of reverse rollers 16 is higher than a nip position of the pair of delivery rollers 14. The pair of delivery rollers 14 is connected to a drive mechanism (not illustrated) and is driven. The pair of reverse rollers 16 is also connected to a drive mechanism (not illustrated) and can be driven so as to be forward/reverse rotatable.

Figure 3A:
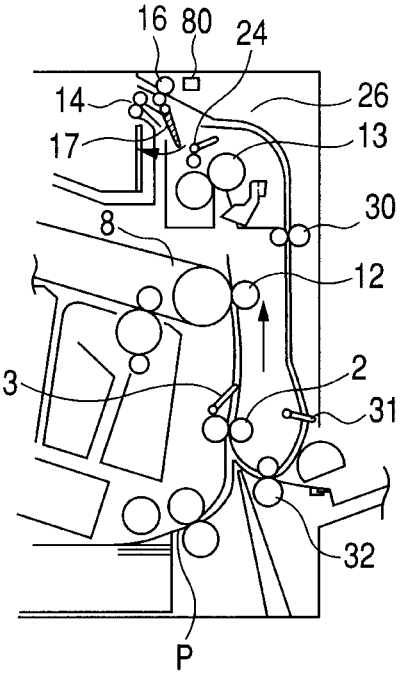
FIGS. 3A and 3B are first views illustrating a sheet transport operation of the laser printer.

If the duplex printing is performed, as illustrated in FIG. 3A, the switching member 17 is turned clockwise around a turning center 17*a* by the drive mechanism (not illustrated), before the sheet P arrives at the branch point B. As a result, the transport path is switched to a position where the transport path can lead to the pair of reverse rollers 16. The switching member 17 is turned at a timing after a predetermined time has elapsed since a point in time when the leading end of the sheet P fed by the sheet feed apparatus 20 is sensed by the top sensor 3.

Figure 3B:
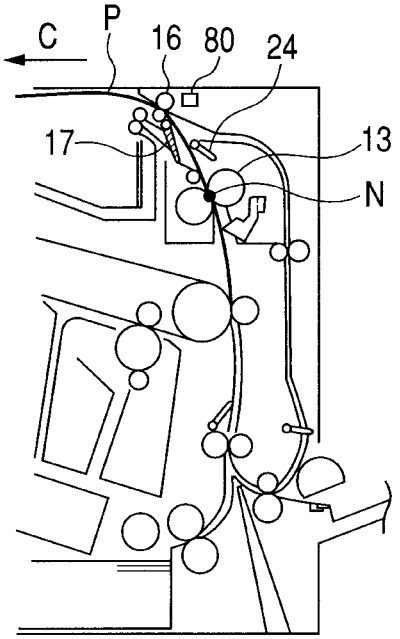

Subsequently, the sheet P, which has passed through the secondary transfer unit T2 and the fixing unit 13, is caused to pass through on an upper surface of the switching member 17, and is transported to the pair of reverse rollers 16 which has already rotated in an delivery direction (a direction for transport in a direction denoted by an arrow C), by the fixing unit 13, as illustrated in FIG. 3B. The pair of reverse rollers 16 transports the sheet P in the direction denoted by the arrow C until the sheet P passes over a fixing roller nip in the fixing unit 13. After the sheet P passes over the fixing roller nip N, the pair of reverse rollers 16 stops the rotation in the delivery direction C so as to stop the transport of the sheet P when the trailing end of the sheet arrives at the switching member, which is a point in time when a predetermined time has elapsed since a reverse sensor 24 senses the trailing end of the sheet P.

Figure 4A:
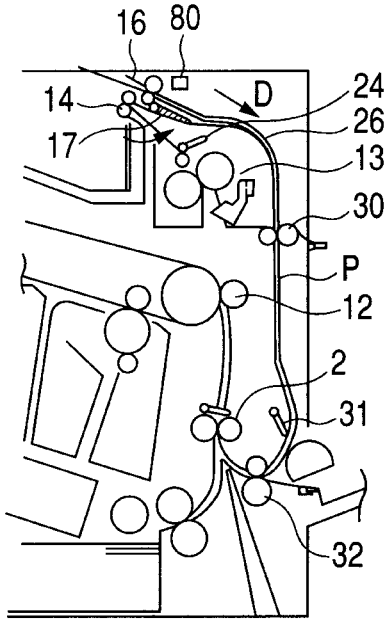
FIGS. 4A and 4B are second views illustrating the sheet transport operation of the laser printer.

Next, after a predetermined time has elapsed after the pair of reverse rollers 16 is stopped, the switching member 17 turns in a counterclockwise direction to a position where the sheet P can be transported to the re-transport path 26, as illustrated in FIG. 4A. Immediately after the switching member 17 turns in the counterclockwise direction, the pair of reverse rollers 16 starts to rotate so as to transport the sheet in a D direction, and transports the sheet P to the re-transport path 26. Subsequently, the sheet P is caused to pass through above the fixing unit 13, and is transported to the re-transport path 26, by the pair of reverse rollers 16. The sheet P which has passed through the re-transport path 26 arrives at the pair of duplex transport rollers 30, and is transported to a duplex transport sensor 31 and a pair of U-turn rollers 32 by the pair of duplex transport rollers 30. Subsequently, the sheet P is guided to the pair of registration rollers 2 again by the pair of U-turn rollers 32.

Figure 4B:
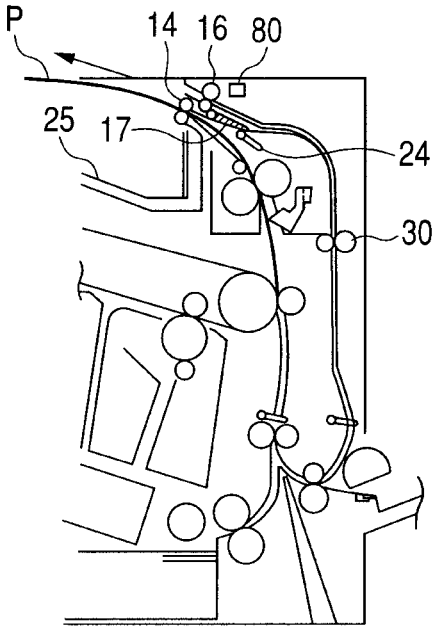

Next, the sheet P which has been subjected to the first-side printing passes through the pair of registration rollers 2. The full-color toner image is transferred onto the reverse side (second side) of the sheet P in the secondary transfer unit T2, and the full-color toner image is fixed by the fixing unit 13. As illustrated in FIG. 4B, at a point in time when the leading end of the sheet P passes over the fixing roller nip, the switching member 17 has already turned to a position where the sheet P is guided to the pair of delivery rollers 14. Subsequently, the sheet P which has been subjected to the duplex printing passes through beneath the switching member 17, and is guided by the pair of delivery rollers 14 so as to be delivered onto the delivery tray 25 by the pair of delivery rollers 14.

Figure 16A:
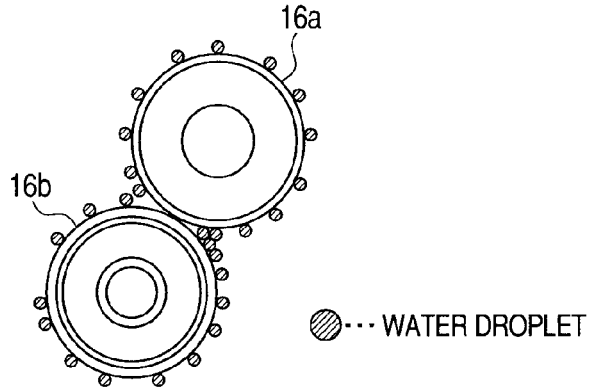
FIGS. 16A, 16B and 16C illustrate a state where water droplets adhere to the pair of reverse rollers.
Figure 16B:
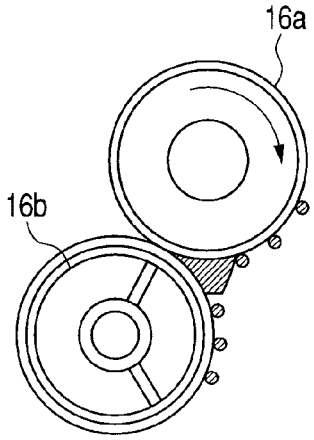
Figure 16C:
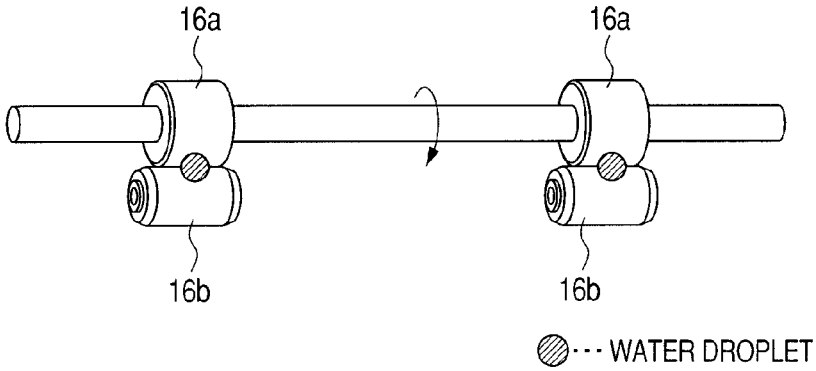

When the toner image is fixed in the fixing unit 13, moisture contained in the sheet P is heated by the fixing unit 13 and evaporates into water vapor. This water vapor is convected upward by warm air, and adheres to a surrounding feed guide and the pair of reverse rollers 16. When the printer main body (the main body of the apparatus) 101 is set in a relatively low temperature state, the water vapor condenses. When the water vapor condenses, water adheres to the sheet P if the duplex printing is performed. Particularly, in a case of cold start, the water notably adheres to the pair of reverse rollers 16 which does not rotate in the first-side printing. FIGS. 16A to 16C illustrate a state where the water vapor has condensed on the pair of reverse rollers. In the first-side printing, since the pair of reverse rollers 16 (16*a* and 16*b*) does not rotate, dew condensation occurs on surfaces of the pair of reverse rollers 16, as illustrated in FIG. 16A. The larger the number of sheets in the first-side printing is, the more the amount of the water vapor generated from the sheets in the fixing unit increases, and thus the amount of water droplets adhering to the surfaces of the pair of reverse rollers 16 increases. If the duplex printing is started immediately after the first-side printing is continuously performed, the pair of reverse rollers 16 rotates clockwise in order to receive the sheet to be subjected to the duplex printing, as illustrated in FIG. 16B. When the pair of reverse rollers 16 rotates, the water droplets condensing on the surfaces of the pair of reverse rollers 16 are collected near a nip portion, and stay in a spherical shape due to surface tension at the nip portion, as illustrated in FIG. 16C. If the sheet is received in this state, the water droplets collected in the spherical shape at the nip portion of the pair of reverse rollers 16 adhere to the sheet, and a poor image is generated when the printing is performed on the second side of the sheet.

Since the amount of the water vapor is proportional to the number of sheets to be subjected to the first-side printing, the larger the number of sheets to be subjected to the first-side printing increases, the more the amount of the dew condensation on the pair of reverse rollers 16 increases. The larger the number of sheets to be subjected to the first-side printing increases, the more the printer main body 101 heats up. When the printer main body 101 heats up, the water vapor that has condensed once evaporates. In other words, even when the water vapor has condensed once, if the printer main body 101 heats up, the dew condensation on the pair of reverse rollers 16 is eliminated.

Consequently, in a state where the water vapor has condensed on the pair of reverse rollers 16, when the image is formed on the reverse side of the sheet after the first-side printing, the sheet is caused to wait depending on the number of sheets in the first-side printing, and then the duplex printing is started. Specifically, a timing (second timing) when a sheet feed operation is started by the sheet feed apparatus 20 is retarded so that the second timing is later than a timing (first timing) when the sheet feed operation is started in the first-side printing, depending on the number of sheets in the first-side printing.

In the present embodiment, the sheet feed operation refers to an operation in which one sheet is separated from a stacked bundle of sheets and is fed out by using the pickup roller 21, the feed roller 22 and the retard roller 23. In the present embodiment, the pickup roller 21, the feed roller 22 and the retard roller 23 in the sheet feed apparatus 20 are used to change a timing when one sheet is fed out of the stacked bundle of sheets. As a mode for changing the timing of the sheet feed operation in which the sheet is fed to the image forming unit 102 by the sheet feed apparatus 20, for example, the timing may be changed as follows. The sheet fed out by the feed roller 22 and the retard roller 23 is stopped once before the image forming unit 102, for example, at the pair of registration rollers 2. The timing when the sheet is fed toward the image forming unit 102 is changed by the pair of registration rollers 2.

A duplex print job in which the images are formed on the both sides of the sheet may be set prior to a first-side print job in which the image is formed on the first side of the sheet. In this case, when the first-side print job is started, the pair of reverse rollers 16 has been heated by the fixed sheet P, and a temperature of the pair of reverse rollers 16 has been raised. If the temperature of the pair of reverse rollers 16 has been raised, the pair of reverse rollers 16 is in a hot state, and it is difficult for dew condensation to occur on the surfaces of the pair of reverse rollers 16. Consequently, if the duplex print job is set prior to the first-side print job, a poor image due to the adherence of the water droplets is difficult to be generated, in comparison with a case where just the duplex print job is set after the first-side print job.

In the present embodiment, if the duplex print job is received after the first-side print job is completed, the wait time before the duplex print job is started, that is, the timing when the sheet feed operation is started, is controlled depending on the temperature of the pair of reverse rollers 16. In other words, if the temperature of the pair of reverse rollers 16 is high, the timing when the sheet feed operation is started is set to a timing (third timing) which is earlier than the second timing and later than the first timing.

In order to directly sense the temperature of the pair of reverse rollers 16, which is required for the control, a temperature sensor 80 which measures a surrounding temperature of the pair of reverse rollers 16 is provided in the side reversing unit 15, as illustrated in FIG. 2. The temperature of the pair of reverse rollers 16 is predicted as will be described later, based on temperature information from the temperature sensor 80. If the duplex print job is set after the first-side print job depending on this predicted temperature, the wait time before the duplex print job is started is controlled so that a poor image due to the adherence of the water droplets may not be generated.

Figure 5:
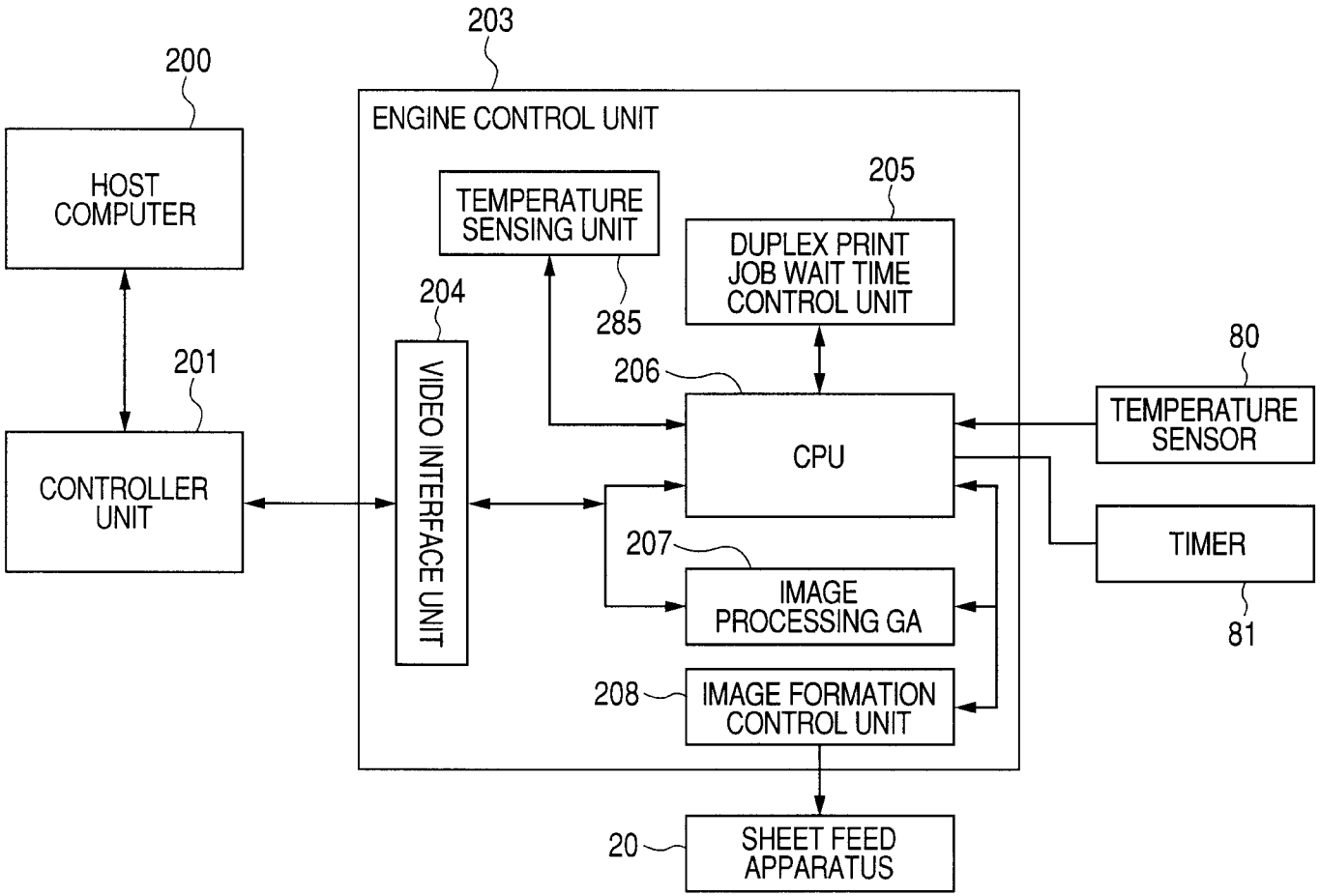
FIG. 5 is a block diagram illustrating a system configuration of the laser printer.

FIG. 5 is a block diagram illustrating a system configuration around the printer, and illustrates a host computer 200, a controller unit 201 provided in the printer main body 101, and an engine control unit 203. The engine control unit 203 includes a video interface unit 204, a CPU (central processing unit) 206, an image processing GA 207, an image formation control unit 208, and a duplex-print-job, wait-time-control unit 205. The engine control unit 203 includes a temperature sensing unit 285. The temperature sensing unit 285 senses the temperature of the pair of reverse rollers 16 by predicting the temperature of the pair of reverse rollers 16 as will be described later, based on the temperature information from the temperature sensor 80. The duplex-print-job, wait-time-control unit 205 manages the wait time before the duplex print job is started, that is, the timing when the sheet feed operation is started by the sheet feed apparatus 20, depending on the predicted temperature predicted by the temperature sensing unit 285 based on the temperature information from the temperature sensor 80.

The controller unit 201 can mutually communicate with the host computer 200 and the engine control unit 203. The CPU 206 of the engine control unit 203 receives a print signal from the host computer 200 via the controller 201, and then outputs a signal for starting one of the duplex print job and the first-side print job, to the image formation control unit 208. For example, if a duplex print job is performed prior to a first-side print job, then the first-side print job is completed, and subsequently, a duplex print job is performed, the CPU 206 receives the print signal. Subsequently, when a wait time W to be described later, which has been set by the duplex-print-job, wait-time-control unit 205, has elapsed, the CPU 206 outputs the signal for starting the duplex print job. The image formation control unit 208 performs a series of processes related to the image formation, such as the transport of the sheet, the transfer and the fixing. The image formation control unit 208 starts one of the duplex print job and the first-side print job based on the signal from the CPU 206, and the sheet feed operation performed by the sheet feed apparatus 20. In FIG. 5, the wait time (interval time) W to be described later is measured by a timer 81.

Figure 6:
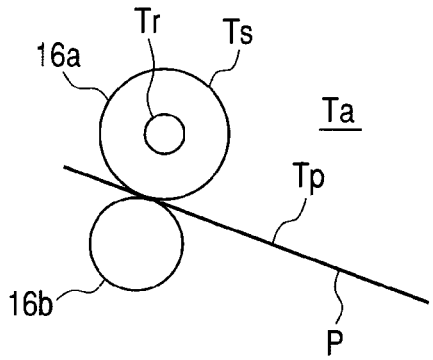
FIG. 6 illustrates a method of predicting a surface temperature of a pair of reverse rollers in the laser printer.

A method of predicting the temperature of the pair of reverse rollers 16, which is performed by the duplex-print-job, wait-time-control unit 205, will be described using FIG. 6. The pair of reverse rollers 16 includes a roller 16*a* constructed from rubber, and a driven roller 16*b* constructed from a mold. The prediction of the temperature of the pair of reverse rollers 16 is performed by predicting a roller surface temperature. A reverse roller surface temperature is Ts, a temperature of a central part of the roller is Tr, a temperature of the sheet P is Tp, an ambient temperature around the pair of reverse rollers 16 is Ta, a heat transfer coefficient within the roller is Kr, a heat transfer coefficient between the roller 16*a* and air is Ka, and a heat transfer coefficient between the roller 16*a* and the sheet P is Kp.

In a cold state immediately after the printer main body 101 is powered on first, the temperature of the roller 16*a* coincides with the temperature sensed by the temperature sensor 80. Thus, the prediction of the temperature is started with that temperature as a starting point. In other words, in the cold state immediately after the printer main body 101 is powered on, Tr=Ts=Ta. Next, the prediction is performed according to the following equations in the following two operation modes.

(1) When the pair of reverse rollers 16 is transporting the sheet P, the roller surface temperature is predicted according to the following equation depending on a time when the sheet P passes through.

The roller surface temperature after the sheet passes through:

$$Ts(\text{after the sheet passes through})=[Tr-Ts(\text{before the sheet passes through})]\cdot Kr+[Tp+Ts(\text{before the sheet passes through})]\cdot Kp+Ts(\text{before the sheet passes through})$$

(2) When the sheet P is not reversed by the pair of reverse rollers 16, the roller surface temperature and the temperature of the central part of the roller are updated according to the following equation at every predetermined time.

The updated roller surface temperature:

$$Ts(\text{after being updated})=[Tr(\text{before being updated})-Ts(\text{before being updated})]\cdot Kr+[Ta-Ts(\text{before being updated})]\cdot Ka+Ts(\text{before being updated})$$

The updated temperature of the central part of the roller:

$$Tr(\text{after being updated})=[Ts(\text{before being updated})-Tr(\text{before being updated})]\cdot Kr+Tr(\text{before being updated})$$

The temperature Tp of the sheet P is actually measured and obtained. The heat transfer coefficients Kr, Ka and Kp are experimentally obtained by collecting data so that predicted values of the pair of reverse rollers 16 almost coincide with actual measured values of the pair of reverse rollers 16. As a result, the temperature of the pair of reverse rollers 16 can be predicted highly precisely. The temperature of the pair of reverse rollers 16, which has been predicted by the above-described method, history of the sheet passing through the pair of reverse rollers 16 in the duplex print job, and the elapsed time are stored in the duplex-print-job, wait-time-control unit 205.

Figure 7:
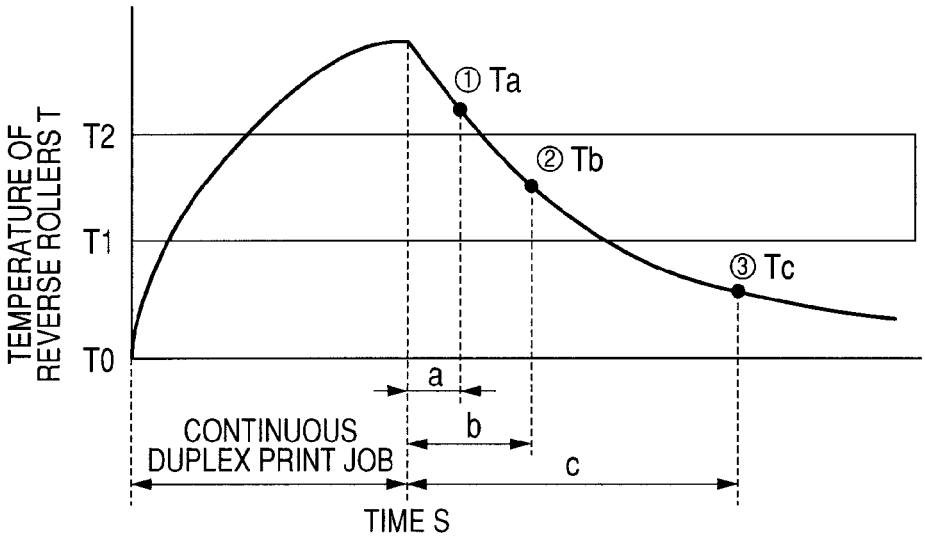
FIG. 7 illustrates the transition of a temperature of the pair of reverse rollers in a case where a continuous duplex print job is performed.

FIG. 7 illustrates transition of the temperature of the pair of reverse rollers 16 in a case where a continuous duplex print job (for example, 20 sheets with 40 images) is performed. Also, as is apparent from FIG. 7, the predicted temperature T of the pair of reverse rollers 16 is raised as the number of sheets to be printed increases, and is lowered over time after the print job is completed.

Figure 8:
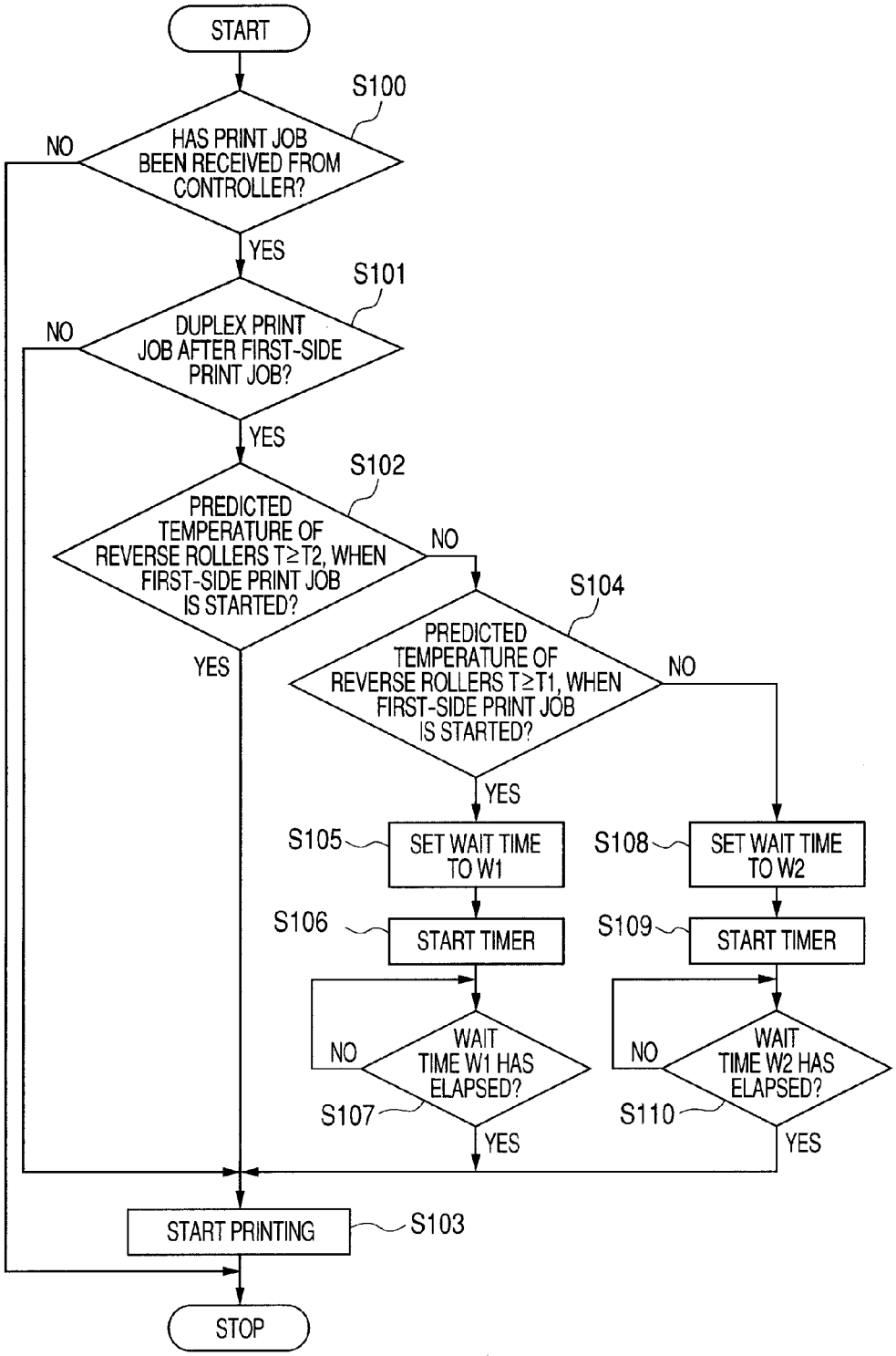
FIG. 8 is a flowchart illustrating control for setting a wait time for a duplex print job after a first-side print job, depending on the temperature of the pair of reverse rollers at a point in time when the first-side print job is started, in the laser printer.

In a case where the print jobs are performed in order of the duplex print job, the first-side print job and the duplex print job, control for setting the wait time for the duplex print job after the first-side print job, depending on the temperature (predicted temperature) T of the pair of reverse rollers 16 at a point in time when the first-side print job is started, will be described using a flowchart illustrated in FIG. 8.

First, the engine control unit 203 receives a signal for the duplex print job after the first-side print job, via the host computer 200 from the controller 201 (Yes in S100). The engine control unit 203 determines whether or not the received print job is the duplex print job after the first-side print job (S101). In this case, the received print job is the duplex print job after the first-side print job is completed after the duplex print job is completed (Yes in S101). Thus, next, the wait time is controlled as follows depending on the predicted temperature of the pair of reverse rollers 16 by the duplex-print-job, wait-time-control unit 205, and the duplex print job is started.

In other words, it is determined whether or not the predicted temperature T of the pair of reverse rollers 16 at a point in time when a continuous first-side print job is started (for example, in FIG. 7, a temperature Ta when a time-a has elapsed after the continuous duplex print job is completed) is equal to or higher than a temperature T2 at which the dew condensation does not occur on the pair of reverse rollers 16 (S102). If T(=Ta)≥T2 (Yes in S102), the dew condensation does not occur on the pair of reverse rollers 16. Thus, the print job is received without any wait time (interval time) provided by the duplex-print-job, wait-time-control unit 205. As a result, the printing (duplex print job) is started at the same timing as a timing (first timing) in a case where the continuous first-side print job is performed by the sheet feed apparatus 20 (S103).

If not T≥T2 (No in S102), next, it is determined whether or not the predicted temperature T of the pair of reverse rollers 16 at the point in time when the continuous first-side print job is started is equal to or higher than a temperature T1 at which a small amount of dew condensation occurs on the surfaces of the pair of reverse rollers 16, and less than T2 (S104). For example, in FIG. 7, it is determined whether or not a temperature Tb when a time-b has elapsed after the continuous duplex print job is completed is equal to or higher than T1 and less than T2. Here, if T(=Tb)≥T1 (Yes in S104), a small amount of dew condensation occurs on the surfaces of the pair of reverse rollers 16. Thus, the duplex-print-job, wait-time-control unit 205 sets the wait time to W1 (S105). Next, the timer 81 is started (S106). When the wait time W1 sufficient for the water droplets on the surfaces of the pair of reverse rollers 16 to evaporate has elapsed (Yes in S107), the print job is received and the printing (duplex print job) is started (S103).

If the predicted temperature T of the pair of reverse rollers 16 at the point in time when the continuous first-side print job is started (for example, in FIG. 7, a temperature Tc when a time-c has elapsed after the continuous duplex print job is completed) is less than T1, a large amount of dew condensation occurs on the surfaces of the pair of reverse rollers 16. In other words, if not T≥T1 (No in S104), a large amount of dew condensation occurs on the surfaces of the pair of reverse rollers 16. Thus, the duplex-print-job, wait-time-control unit 205 sets the wait time to W2 which is longer than W1 (S108). Next, the timer 81 is started (S109). When the wait time W2 sufficient for the water droplets on the surfaces of the pair of reverse rollers 16 to evaporate has elapsed (Yes in S110), the print job is received and the printing (duplex print job) is started (S103).

Figure 9:
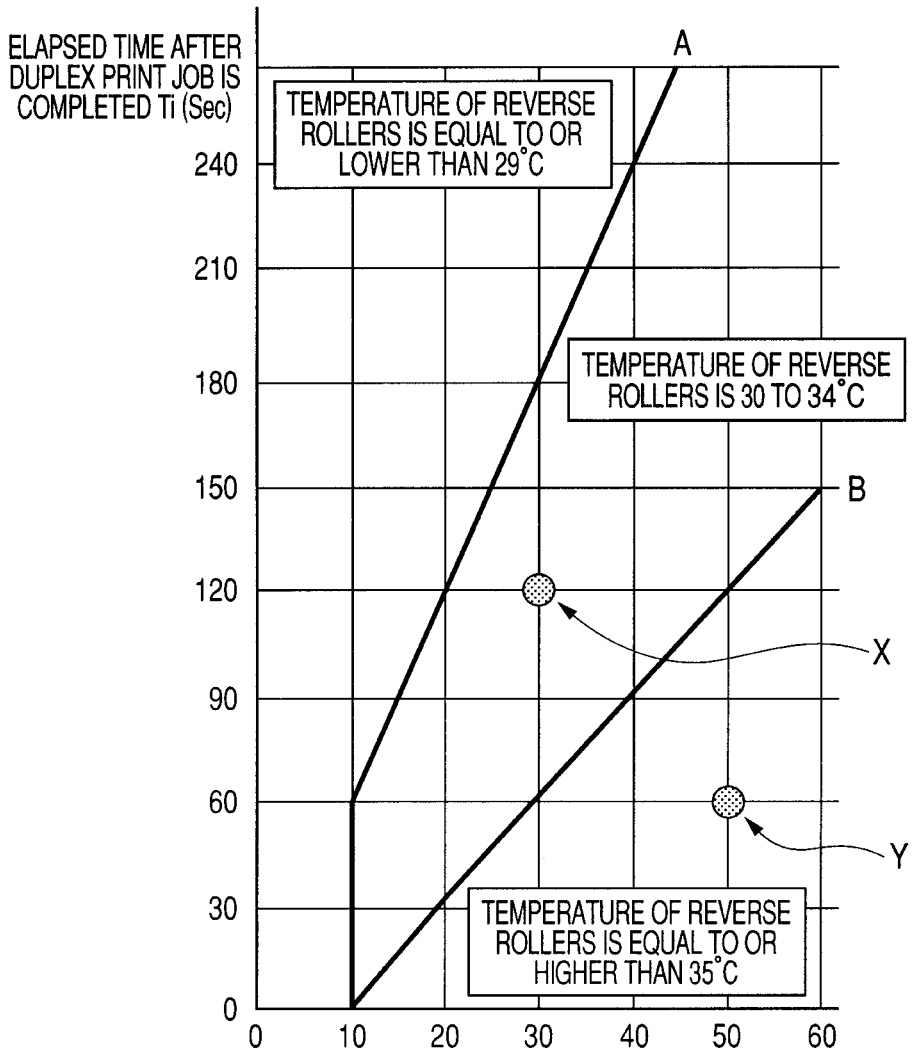
FIG. 9 illustrates examples of the control for setting the wait time for the duplex print job, depending on the temperature of the pair of reverse rollers.

FIG. 9 illustrates examples 1 and 2 of such control. In the present example, a printer with a printing speed of 40 PPM (A4, vertical) is installed under an environment of a room temperature of 23° C. and humidity of 50%, and conditions of parameters in FIG. 7 are set so that T1=30° C, T2=35° C, W1=20 seconds and W2=60 seconds. In FIG. 9, the X-axis indicates the number of sheets in the duplex print job to be set first, and the Y-axis indicates an elapsed time after the duplex print job which is executed first is completed. Line A indicates a line on which the temperature of the pair of reverse rollers 16 becomes approximately 30° C, and Line B indicates a line on which the temperature of the pair of reverse rollers 16 becomes 35° C.

EXAMPLE1

In the present example, the printing is set for a duplex print job of 30 sheets (60 images), a first-side print job of 50 sheets, and a duplex print job. X in FIG. 9 indicates the surface temperature of the pair of reverse rollers 16 in a case where the duplex print job of 30 sheets is performed, and at a point in time when 120 seconds have elapsed after the duplex print job has been completed, the first-side print job of 50 sheets is started, and the engine control unit 203 receives the print signal for the duplex print job immediately after the first-side print job.

When the duplex print job of 30 sheets is performed, the temperature of the pair of reverse rollers 16 is continuously raised until the duplex print job is completed, and becomes equal to or higher than approximately 45° C. at a point in time when the print job is completed, as illustrated in FIG. 7. After the print job is completed, the temperature of the pair of reverse rollers 16 is continuously lowered over time, and becomes approximately 33° C. at 120 seconds after the print job is completed.

At this point in time, the first-side print job of 50 sheets is started. Here, the temperature T of the pair of reverse rollers 16 at the point in time when the first-side print job is started is 33° C., which is located in an area within Line A and Line B in FIG. 9. In this case, a relationship of T1<T<T2 is established, and the wait time is set to W1 (=20 seconds) under the control of the duplex-print-job, wait-time-control unit 205, as illustrated in FIG. 8. After the wait time of 20 seconds has elapsed since the first-side print job of 50 sheets has been completed, the next duplex print job is started. If this control is not performed, the wait time W is set to W2 (=60 seconds). Therefore, the wait time can be reduced to ⅓ by performing this control.

EXAMPLE 2

In the present example, the printing is set for a duplex print job of 50 sheets (100 images), a first-side print job of 50 sheets, and a duplex print job. Yin FIG. 9 indicates the surface temperature of the pair of reverse rollers 16 in a case where the duplex print job of 50 sheets is performed, and at a point in time when 60 seconds have elapsed after the duplex print job has been completed, the first-side print job of 50 sheets is started, and the duplex print job is performed immediately after the first-side print job.

When the duplex print job of 50 sheets is performed, the temperature of the pair of reverse rollers 16 is continuously raised until the duplex print job is completed, and becomes equal to or higher than approximately 50° C. at the point in time when the print job is completed, as illustrated in a graph of FIG. 7. After the print job is completed, the temperature of the pair of reverse rollers 16 is continuously lowered over time, and becomes approximately 42° C. at 60 seconds after the print job is completed.

At this point in time, the first-side print job of 50 sheets is started. Here, the temperature of the pair of reverse rollers 16 at the point in time when the first-side print job is started is 42° C., which is located in an area under Line B in FIG. 9. In this case, a relationship of T>T2 is established, and the wait time is set to W1=0 second under the control of the duplex-print-job, wait-time-control unit 205, as illustrated in FIG. 8. After the first-side print job of 50 sheets is completed, the next duplex print job is started with the wait time of 0.

In the present embodiment, after the duplex print job is completed, the temperature T of the pair of reverse rollers 16 at the point in time when the first-side print job is started is predicted. Depending on a status of the prediction, the wait time between the first-side print job and the duplex print job after the first-side print job is set. The higher the temperature of the pair of reverse rollers 16 is, the greater the wait time (interval time) between the first-side print job and the duplex print job after the first-side print job is reduced. As the temperature of the pair of reverse rollers 16 is lower, an interval between the last sheet in the first-side print job and the first sheet in the duplex print job is increased.

If the duplex print job is performed before the first-side print job, and the duplex print job is received after the first-side print job is completed, the sheet feed apparatus 20 is controlled to start the sheet feed operation at a timing earlier than the timing when the sheet feed operation is started for performing the duplex print job after the first-side print job. As a result, a user can prevent reduction in an image quality level due to the dew condensation, with a minimum necessary amount of the wait time.

The present embodiment has been described in the case where the printing is set for the duplex print job, the first-side print job and the duplex print job. However, if the duplex print job is set after the first-side print job, the wait time between the first-side print job and the subsequent duplex print job may be controlled depending on the temperature T of the pair of reverse rollers 16, which is constantly predicted, regardless of a status of a previous print job. In other words, if the duplex print job is set after the first-side print job, the wait time may be controlled depending on the temperature T of the pair of reverse rollers 16, whatever print job is set before the first-side print job, or whether any print job is set or not.

The sensing of the temperature of the pair of reverse rollers 16 by the temperature sensing unit 285 in the present invention also includes the prediction of the temperature as described above. As an example of the prediction of the temperature, a mode has been described above in which the temperature of the pair of reverse rollers 16 is predicted with reference to the temperature which has been actually sensed (measured) by the temperature sensor 80, based on the number of sheets in the duplex print job before the first-side print job and a length of time before the first-side print job is started. However, the prediction does not necessarily need to be performed with reference to the temperature which has been actually measured by the temperature sensor 80. The temperature of the pair of reverse rollers 16 may be predicted based on the number of sheets in the duplex print job before the first-side print job and the length of time before the first-side print job is started.

With the digitalization and multi-functionalization of printers in recent years, for example, if an image reading unit is arranged above a main body of a printer, the above-described discharge of the water vapor through a louver may be difficult in many cases because of the image reading unit as an obstacle. In a case of an inner-delivery type in which the sheet with the image formed thereon is delivered between the printer main body and the image reading unit, it is effective to control a duplex printing start timing to be retarded as the first and second embodiments, in order to avoid problem associated with the water droplets in the duplex printing.

In a case where an apparatus of the inner-delivery type is provided with a relay transport unit which transports the sheet with the image formed thereon to a sheet processing unit provided on the side of the printer main body and is arranged in an inner space, the discharge of the water vapor through the louver is difficult because of the relay transport unit. Also in a configuration including the relay transport unit, it is effective to control the duplex printing start timing to be retarded in order to avoid the problem associated with the water droplets in the duplex printing.

Figure 10:
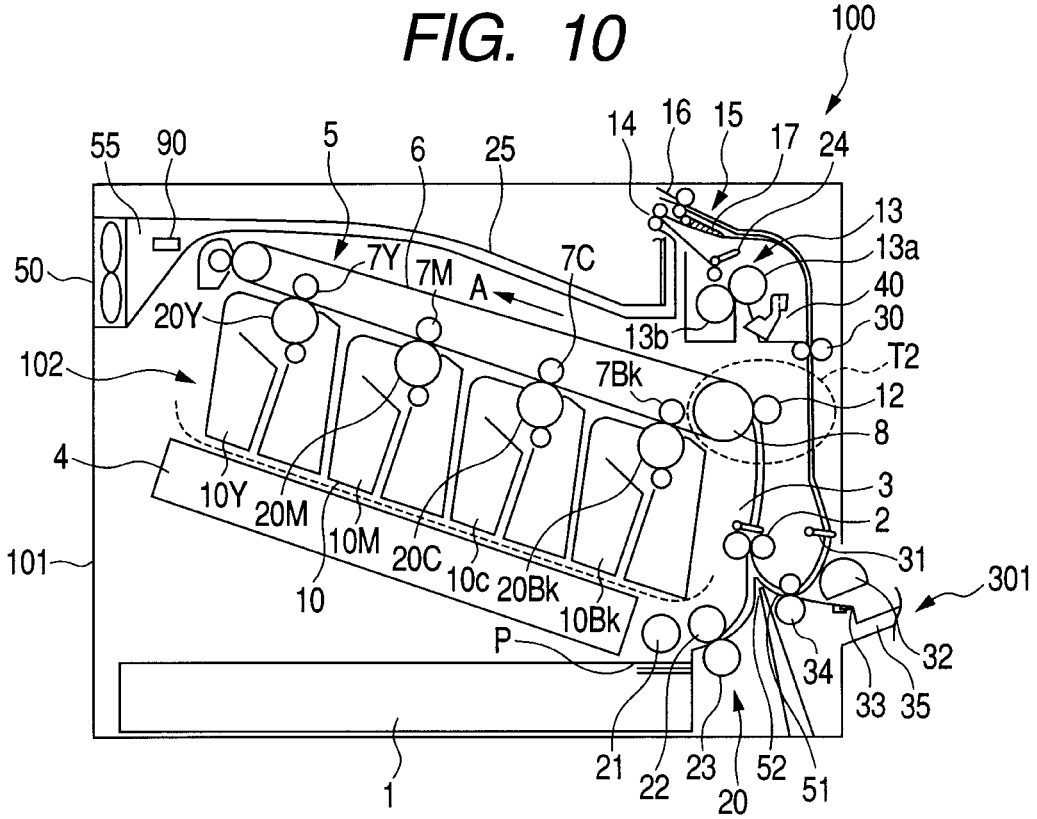
FIG. 10 illustrates a configuration of a laser printer which is an example of the image forming apparatus according to a second embodiment of the present invention.

The second embodiment of the present invention will be described. FIG. 10 is a view illustrating a configuration of a laser printer which is an example of the image forming apparatus according to the present embodiment. In FIG. 10, the same reference numerals and characters as those of FIG. 1 denote the same or corresponding components. In FIG. 10, a temperature sensing sensor 90 senses an ambient temperature at which the printer main body (the main body of the image forming apparatus) 101 is installed. In addition, the CPU 206 of the engine control unit 203, which is a control unit illustrated in FIG. 5, changes a transfer condition and a fixing condition through the image formation control unit 208 based on temperature information (sensing result) from the temperature sensing sensor 90, in order to perform optimal image formation.

In the present embodiment, the CPU 206 of the engine control unit 203 predicts the surface temperature of the pair of reverse rollers 16, based on the temperature information from the temperature sensing sensor 90 and information on the print job. This temperature sensing sensor 90 may be provided at an arbitrary position. In the present embodiment, the ambient temperature at which the printer main body 101 is installed is sensed through an outside air temperature. Consequently, the temperature sensing sensor 90 is provided in an air path 55 illustrated in FIG. 10 so that the outside air taken in through the fan 50 can be measured.

In the present embodiment, the temperature sensing sensor 90 is provided instead of measuring the ambient temperature Ta around the pair of reverse rollers 16 so as to indirectly sense the temperature of the pair of reverse rollers 16. As a result, the surface temperature of the pair of reverse rollers 16 is indirectly predicted. Specifically, the ambient temperature Ta around the pair of reverse rollers 16 is predicted by adding a temperature for raising the surrounding temperature of the pair of reverse rollers, to a temperature Tg detected by the temperature sensing sensor 90, each time one sheet P is transported.

For example, the predicted ambient temperature around the pair of reverse rollers 16 is Ta', and the temperature sensed by the temperature sensing sensor 90 is Tg. If it is assumed that Ta'=Tg in the cold state, the ambient temperature Ta' around the pair of reverse rollers 16 after the sheet passes through is given as the following equation. In the following equation, Kf is a heat transfer coefficient between the sheet P and the air, and Kk is a heat transfer coefficient in the air.

$$Ta'(\text{after the sheet passes through})=[Tp-Ta'(\text{before the sheet passes through})]\cdot Kf+Ta'(\text{before the sheet passes through})$$

When the pair of reverse rollers 16 is not transporting the sheet P, the ambient temperature Ta around the pair of reverse rollers 16 is predicted and updated every second as the following equation.

$$Ta'(\text{after being updated})=[Tg-Ta'(\text{before being updated})]\cdot Kk+Ta'(\text{before being updated})$$

This predicted or updated ambient temperature Ta' around the pair of reverse rollers 16 is used to predict the surface temperature of the pair of reverse rollers 16 similarly to the above-described first embodiment. As a result, the control can be performed similarly to the first embodiment.

In the present embodiment, the surface temperature of the pair of reverse rollers is predicted based on the ambient temperature which can be obtained by the temperature sensing sensor 90 provided within the printer main body (within the main body of the image forming apparatus), and information on the duplex print job. As a result, the surface temperature of the pair of reverse rollers can be predicted without providing a temperature detection unit dedicated to measure the surface temperature of the pair of reverse rollers. As a result, costs can be reduced.

Figure 11:
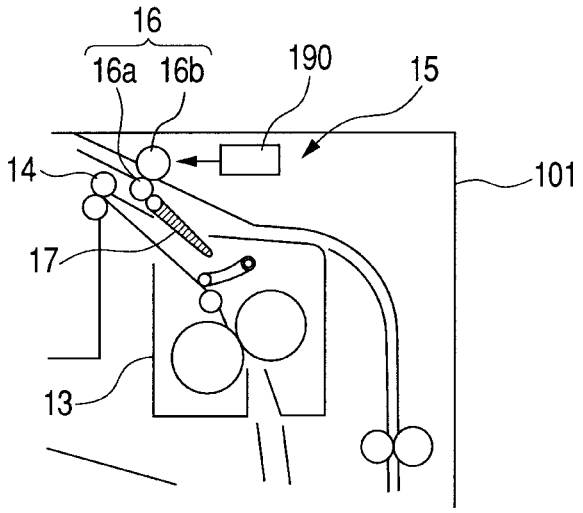
FIG. 11 is an enlarged view of a main portion of a laser printer which is an example of the image forming apparatus according to a third embodiment of the present invention.

A third embodiment of the present invention will be described. FIG. 11 is an enlarged view of a main portion of a laser printer which is an example of the image forming apparatus according to the present embodiment. In FIG. 11, the same reference numerals and characters as those of FIG. 2 denote the same or corresponding components. In FIG. 11, a radiation thermometer 190 as the temperature sensing unit is provided in the side reversing unit 15, and directly measures the surface temperature of the rubber 16*a* included in the pair of reverse rollers 16, in a noncontact manner.

In the duplex print job, when the sheet P heated by the fixing in the first-side printing is transported by the pair of reverse rollers 16, the heat of the sheet is transferred, and thus the temperature of the pair of reverse rollers 16 is raised. Since the radiation thermometer 190 is provided, this raising of the temperature of the pair of reverse rollers 16 can be directly measured. Since the temperature of the pair of reverse rollers 16 is directly measured (sensed), the temperature of the pair of reverse rollers 16 can be sensed with improved precision. As a result, the wait time before the duplex print job is started can be more appropriately set.

Figure 12:
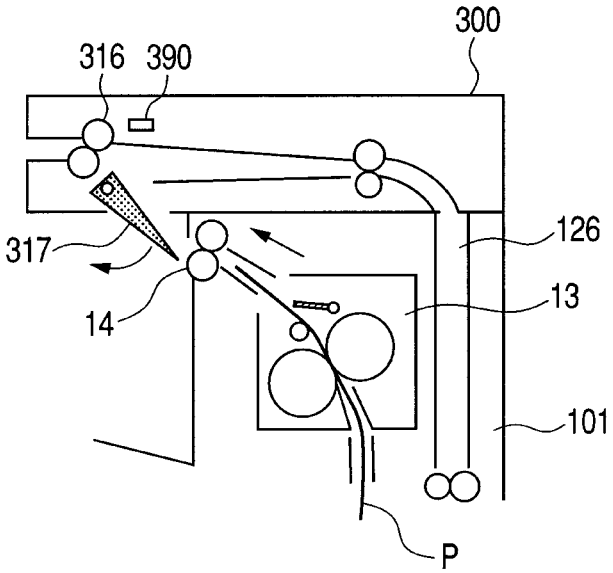
FIG. 12 is an enlarged view of a main portion of a laser printer which is an example of the image forming apparatus according to a fourth embodiment of the present invention.

A fourth embodiment of the present invention will be described. FIG. 12 is an enlarged view of a main portion of a laser printer which is an example of the image forming apparatus according to the present embodiment. In FIG. 12, the same reference numerals as those of FIG. 2 denote the same or corresponding components. In FIG. 12, a duplex transport apparatus 300 as a duplex transport unit can be optionally mounted on the printer main body 101. When the duplex transport apparatus 300 is mounted on the printer main body 101, the duplex transport apparatus 300 includes a switching member 317 located on a downstream side of the pair of delivery rollers 14, reverse rollers 316 provided on a downstream side of the switching member 317, and a temperature sensor 390 provided near the reverse rollers 316.

In a case where the duplex transport apparatus 300 is mounted, if the duplex printing is performed, first, the switching member 317 is turned clockwise as denoted by an arrow, and is moved to a position illustrated in FIG. 12. After the first-side printing is performed, the transport path through which the sheet P is transported by the pair of delivery rollers 14 is switched to a direction toward a pair of the reverse rollers 316. Next, the sheet P is transported by the pair of reverse rollers 316, and then, the pair of reverse rollers 316 is reversed so as to transport the sheet P to a duplex transport path 126. Subsequently, the image is formed on the reverse side of the sheet P.

In the present embodiment, a surface temperature of the reverse rollers 316 at the point in time when the first-side print job is started is predicted based on an ambient temperature near the pair of reverse rollers, which can be obtained by the temperature sensor 390, and the information on the duplex print job, according to a method similar to the first embodiment. Depending on the predicted surface temperature of the reverse rollers 316, the wait time between the first-side print job and the duplex print job after the first-side print job is set. As a result, the user can perform the printing without poor image, with the minimum necessary amount of the wait time.

Figure 13:
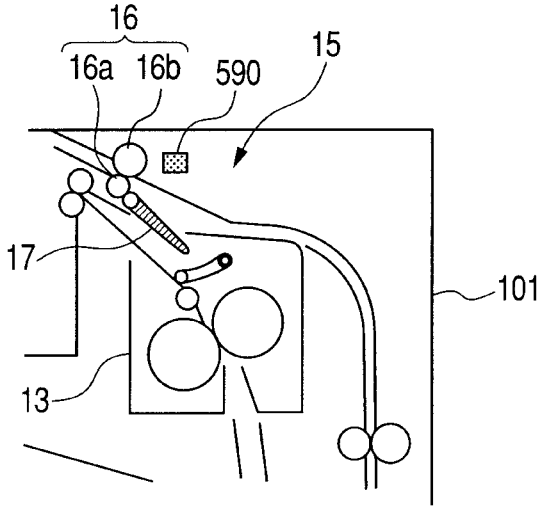
FIG. 13 is an enlarged view of a main portion of a laser printer which is an example of the image forming apparatus according to a fifth embodiment of the present invention.

A fifth embodiment of the present invention will be described. FIG. 13 is an enlarged view of a main portion of a laser printer which is an example of the image forming apparatus according to the present embodiment. In FIG. 13, the same reference numerals and characters as those of FIG. 2 denote the same or corresponding components. In FIG. 13, a temperature/humidity sensing unit 590 is provided in the side reversing unit 15, and senses a temperature and humidity near the pair of reverse rollers 16. Since the temperature/humidity sensing unit 590, which senses not only the temperature but also the humidity as a humidity sensing unit, is provided, the humidity near the pair of reverse rollers can also be sensed in addition to the temperature near the pair of reverse rollers. Since the temperature and the humidity near the pair of reverse rollers are sensed, a state of the dew condensation on the pair of reverse rollers 16 can be more accurately understood. As a result, if the duplex print job is received after the printing for the first-side print job is completed, the wait time W controlled by the duplex-print-job, wait-time-control unit 205 can be more appropriately set. As a result, the wait time W can be more reduced.

Figure 14:
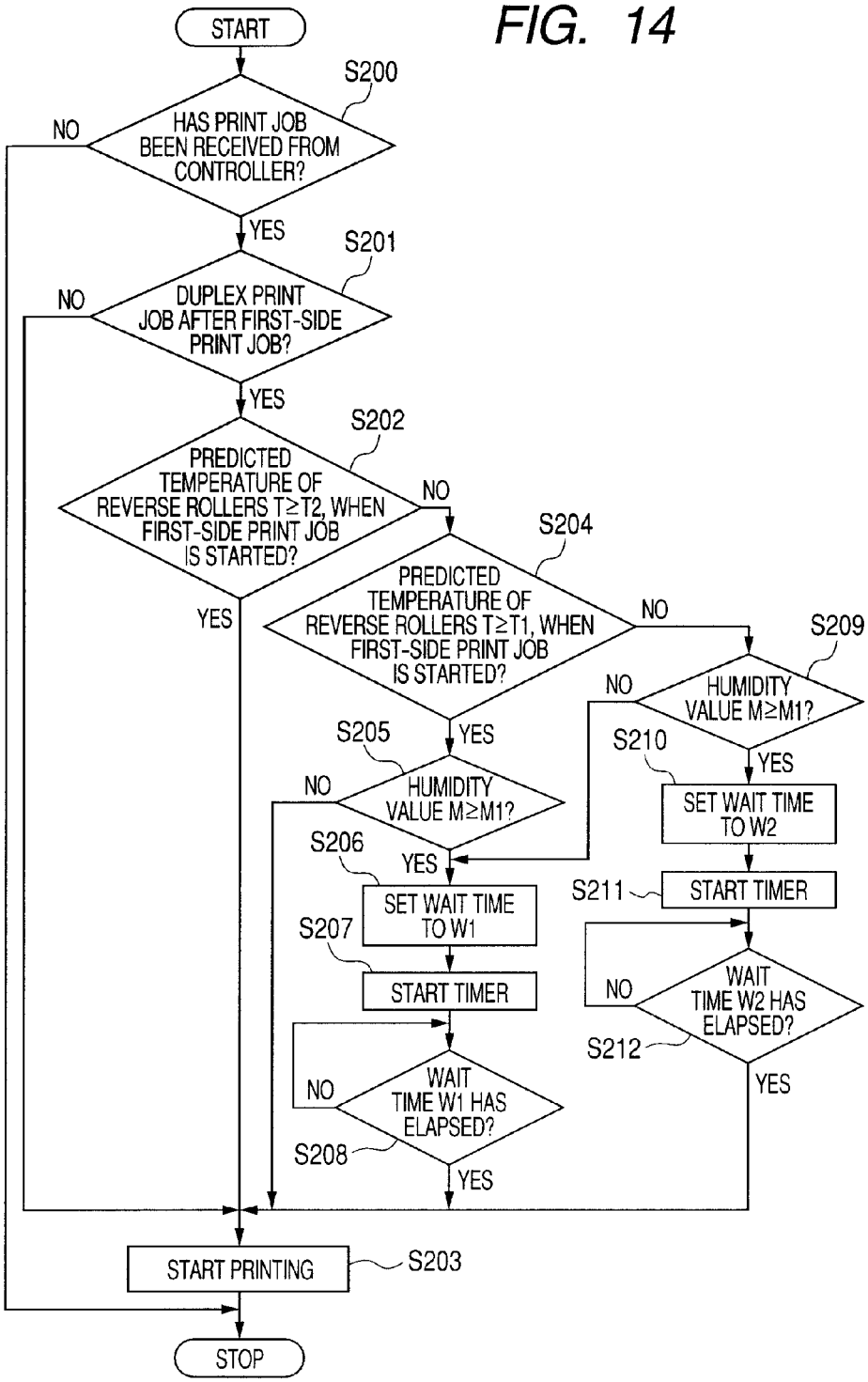
FIG. 14 is a flowchart illustrating the control for setting the wait time for the duplex print job after the first-side print job, depending on the temperature of the pair of reverse rollers at the point in time when the first-side print job is started, in the printer.

In a case where the image formation is performed in order of the duplex print job, the first-side print job and the duplex print job, the control for setting the wait time for the duplex print job after the first-side print job, depending on the temperature T of the pair of reverse rollers 16 at the point in time when the first-side print job is started, according to the present embodiment, will be described using a flowchart illustrated in FIG. 14.

First, the engine control unit 203 receives the signal for the duplex print job after the first-side print job, via the host computer 200 from the controller 201 (Yes in S200). The engine control unit 203 determines whether or not the received print job is the duplex print job after the first-side print job (S201). In this case, the received print job is the duplex print job after the first-side print job (Yes in S201). Thus, next, the wait time is controlled as follows depending on the predicted temperature of the pair of reverse rollers 16 by the duplex-print-job, wait-time-control unit 205, and the duplex print job is started.

It is determined whether or not the predicted temperature T of the pair of reverse rollers 16 at the point in time when the continuous first-side print job is started is equal to or higher than T2 (S202). Here, if T≥T2 (Yes in S202), the dew condensation does not occur on the pair of reverse rollers 16. Thus, the print job is received without wait time (interval time) provided by the duplex-print-job, wait-time-control unit 205, and the printing is immediately started (S203).

If not T≥T2 (No in S202), next, it is determined whether or not the predicted temperature T of the pair of reverse rollers 16 at the point in time when the continuous first-side print job is started is equal to or higher than T1 and less than T2 (S204). Here, if T≥T1 (Yes in S204), next, it is determined whether or not a value M of the humidity near the pair of reverse rollers, which has been sensed by the temperature/humidity sensing unit 590, is equal to or higher than a predetermined value M1 (for example, 20%) (S205). Then, if the humidity value M is less than the predetermined value M1 (No in S205), the dew condensation does not occur on the pair of reverse rollers 16 even though T≥T1. Thus, the printing is immediately started (S203).

If the humidity value M is equal to or higher than the predetermined value M1 (Yes in S205), a small amount of dew condensation occurs on the surfaces of the pair of reverse rollers 16. Thus, the duplex-print-job, wait-time-control unit 205 sets the wait time to W1 (S206). Next, the timer 81 is started (S207). When the wait time W1 sufficient for the water droplets on the surfaces of the pair of reverse rollers 16 to evaporate has elapsed (Yes in S208), the print job is received and the printing is started (S203).

If the predicted temperature T of the pair of reverse rollers 16 at the point in time when the continuous first-side print job is started is less than T1, a large amount of dew condensation occurs on the surfaces of the pair of reverse rollers 16. If not T≥T1 (No in S204), next, it is determined whether or not the value M of the humidity sensed by the temperature/humidity sensing unit 590 is equal to or higher than the predetermined value M1 (S209). If the humidity value M is less than the predetermined value M1 (No in S209), a small amount of dew condensation occurs on the surfaces of the pair of reverse rollers 16. Thus, the duplex-print-job, wait-time-control unit 205 sets the wait time to W1 (S206).

If the humidity value M is equal to or higher than the predetermined value M1 (Yes in S209), a large amount of dew condensation occurs on the surfaces of the pair of reverse rollers 16. Thus, the duplex-print-job, wait-time-control unit 205 sets the wait time to W2 which is longer than W1 (S210). Next, the timer 81 is started (S211). When the wait time W2 sufficient for the water droplets on the surfaces of the pair of reverse rollers 16 to evaporate has elapsed (Yes in S212), the print job is received and the printing is started (S203).

In the present embodiment, after the temperature of the pair of reverse rollers 16 is predicted, if the humidity value M sensed by the temperature/humidity sensing unit 590 is less than the predetermined value, the setting of the wait time W is controlled so that the wait time W is changed to be one step shorter. If the humidity value sensed by the temperature/humidity sensing unit 590 is equal to or higher than the predetermined value M1, the wait time is controlled similarly to the first embodiment. Since the wait time is controlled depending on information on the humidity sensed by the temperature/humidity sensing unit 590, the printing without poor image due to the water droplets is enabled with a further shorter wait time.

Figure 15:
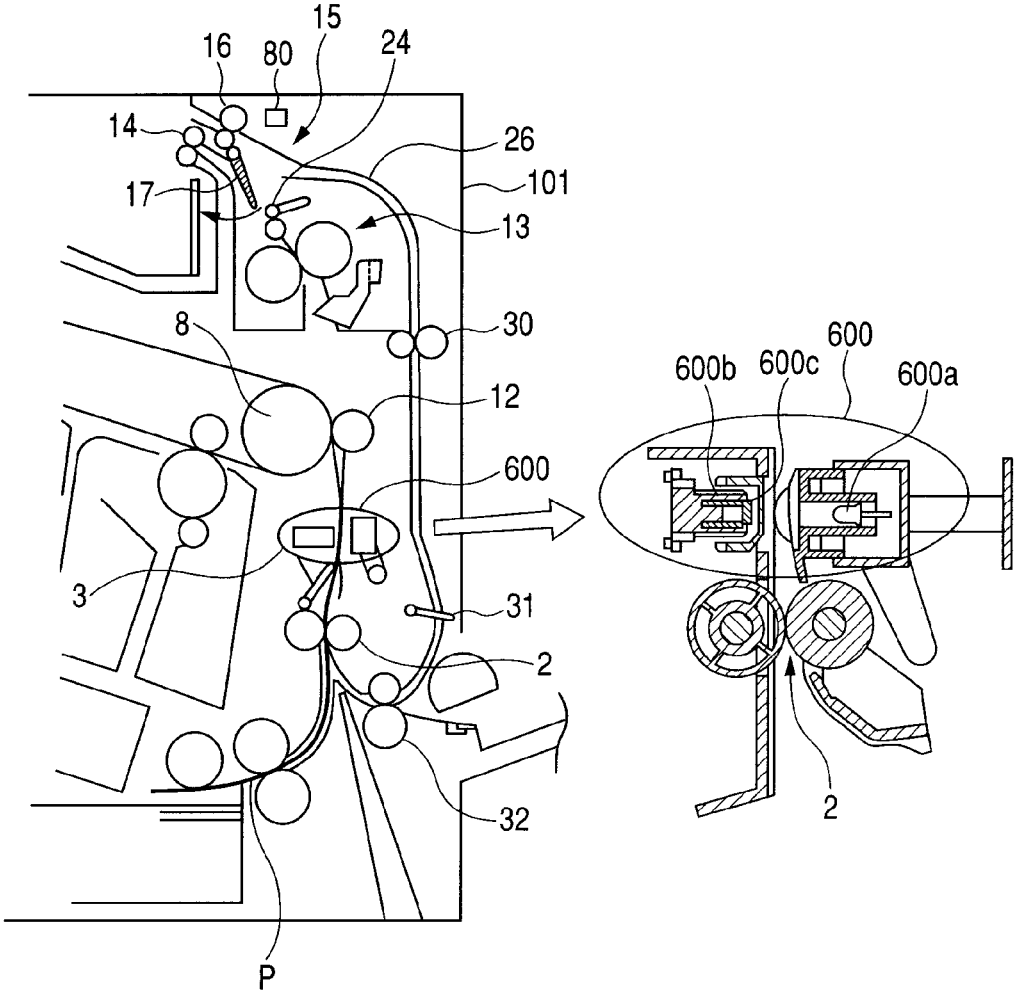
FIG. 15 illustrates a configuration of a part of a laser printer which is an example of the image forming apparatus according to a sixth embodiment of the present invention.

A sixth embodiment of the present invention will be described. FIG. 15 illustrates a configuration of a part of a laser printer which is an example of the image forming apparatus according to the present embodiment. In FIG. 15, the same reference numerals and characters as those of FIG. 1 denote the same or corresponding components.

In FIG. 15, a sheet discriminating sensor unit 600 as a discriminating unit is provided on the downstream side of the pair of registration rollers 2. The sheet discriminating sensor unit 600 discriminates whether or not the sheet is a sheet with a high moisture content. The CPU 206 of the engine control unit 203 discriminates whether or not the sheet to be transported is the sheet with a high moisture content, based on discrimination information from this sheet discriminating sensor unit 600. The sheet discriminating sensor unit 600 includes a transmitted light LED 600*a*, a reflected light LED 600*b* and an image reading sensor 600*c*. The sheet discriminating sensor unit 600 outputs the discrimination information indicating whether or not the sheet is the sheet with a high moisture content, and also detects the position of the sheet.

The CPU 206 controls the wait time W before the duplex print job is started, based on a result of the prediction of the temperature of the pair of reverse rollers 16 as described above, and the discrimination information from the sheet discriminating sensor unit 600. For example, in FIG. 7, if the predicted temperature of the pair of reverse rollers 16 is Tb, the wait time is set to W1. However, if the sheet discriminating sensor unit 600 senses a thin paper with a low moisture content per sheet and a gloss film with hardly any moisture content, W1 is reduced.

In the present embodiment, it is discriminated whether or not the sheet is the sheet with a high moisture content, based on the discrimination information from the sheet discriminating sensor unit 600. If the duplex print job is received after the printing for the first-side print job is completed, the wait time W before the duplex print job is started is controlled depending on a result of the discrimination. As a result, the printing without poor image due to the water droplets is enabled with a further shorter wait time. In other words, if it is determined that the sheet is a sheet with a low moisture content, based on the result of the discrimination in the sheet discriminating sensor unit 600, the sheet feed operation is controlled to be started at an earlier timing. As a result, the printing without poor image due to the water droplets is enabled with a further shorter wait time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-251390, filed Oct. 30, 2009, which is hereby incorporated by reference herein in its entirety.

What is claimed is:

1. An image forming apparatus, comprising:

a sheet feed unit which feeds a sheet to an image forming unit forming a toner image on the sheet;

a fixing unit which fixes the toner image formed by the image forming unit to the sheet;

a re-transport roller which re-transports the sheet with the toner image fixed on one side of the sheet to the image forming unit for forming an image on another side of the sheet; and a control unit which controls a sheet feed operation of the sheet feed unit, wherein, when a subsequent duplex image formation in which an image is formed on both sides of a sheet is started after a one-side image formation in which an image is formed on one side of a sheet is completed, the control unit reduces a wait time, from the end of a sheet feed operation for feeding a last sheet in the one side image formation to the start of a sheet feed operation for feeding a first sheet in the subsequent duplex image formation, as the number of sheets subjected a preceding duplex image formation, in which an image is formed on both sides of a sheet before the one-side image formation, increases.

2. The image forming apparatus according to claim 1, wherein, when the subsequent duplex image formation is started after the one-side image formation is completed, the control unit reduces the wait time, as the number of sheets subjected the preceding duplex image formation before the one-side image formation increases, and a time from the end of the preceding duplex image formation to the start of the one-side image formation decreases.

3. An image forming apparatus, comprising:

a sheet feed unit which feeds a sheet to an image forming unit forming a toner image on the sheet;

a fixing unit which fixes the toner image formed by the image forming unit to the sheet;

a re-transport roller which re-transports the sheet with the toner image fixed on one side of the sheet to the image forming unit for forming an image on another side of the sheet; and a control unit which controls a sheet feed operation of the sheet feed unit, wherein, when a subsequent duplex image formation in which an image is formed on both sides of a sheet is started after a one-side image formation in which an image is formed on one side of a sheet is completed, the control unit reduces a wait time, from the end of a sheet feed operation for feeding a last sheet in the one side image formation to the start of a sheet feed operation for feeding a first sheet in the subsequent duplex image formation, as a time from the end of a preceding duplex image formation, in which an image is formed on both sides of a sheet before the one-side image formation, to the start of the one-side image formation decreases.

4. An image forming apparatus, comprising:

a sheet feed unit which feeds a sheet to an image forming unit forming a toner image on the sheet;

a fixing unit which fixes the toner image formed by the image forming unit to the sheet;

a re-transport roller which re-transports the sheet with the toner image fixed on one side of the sheet to the image forming unit for forming an image on another side of the sheet; and a control unit which controls a sheet feed operation of the sheet feed unit, wherein, in a case that a subsequent duplex image formation, in which an image is formed on both sides of a sheet, is performed after completion of a one-side image formation, in which an image is formed on one side of a sheet, the control unit sets a shorter wait time, from the end of a sheet feed operation for feeding a last sheet in the one side image formation to the start of a sheet feed operation for feeding a first sheet in the subsequent duplex image formation, when a preceding duplex image formation, in which an image is formed on both sides of a sheet before the one-side image formation, has been executed on a first number of sheets, than a wait time when the preceding duplex image formation has been executed on a second number of sheets fewer than the first number of sheets.

5. The image forming apparatus according to claim 4, wherein, at a time when starting the subsequent duplex image formation after the completion of the one-side image formation, the control unit sets a shorter wait time, from the end of a sheet feed operation for feeding the last sheet in the one-side image formation to the start of a sheet feed operation for feeding the first sheet in the subsequent duplex image formation, as a number of sheets is increased in the preceding duplex image formation performed before the one-side image formation and/or as a time period from the completion of the preceding duplex image formation to start of the one-side image formation is shortened.

6. An image forming apparatus, comprising:

a sheet feed unit which feeds a sheet to an image forming unit forming a toner image on the sheet;

a fixing unit which fixes the toner image formed by the image forming unit to the sheet;

a re-transport roller which re-transports the sheet with the toner image fixed on one side of the sheet to the image forming unit for forming an image on another side of the sheet; and a control unit which controls a sheet feed operation of the sheet feed unit, wherein, in a case that a subsequent duplex image formation, in which an image is formed on both sides of a sheet, is performed after completion of a one-side image formation, in which an image is formed on one side of a sheet, the control unit sets a shorter wait time, from the end of a sheet feed operation for feeding a last sheet in the one side image formation to the start of a sheet feed operation for feeding a first sheet in the subsequent duplex image formation, when the one-side image formation is executed after a first time period is elapsed from the completion of a preceding duplex image formation, than a wait time when the one-side image formation is executed after a second time period longer than the first time period is elapsed from the completion of the preceding duplex-side image formation.

* * * * *